United States Patent [19]

Vetterli

[11] 4,192,128

[45] Mar. 11, 1980

[54] THREAD DEFLECTING ELEMENT FOR A DRAW-TEXTURING MACHINE

[75] Inventor: Walter Vetterli, Winterthur, Switzerland

[73] Assignee: Rieter Machine Works, Ltd., Winterthur, Switzerland

[21] Appl. No.: 926,130

[22] Filed: Jul. 19, 1978

[30] Foreign Application Priority Data

Jul. 23, 1977 [CH] Switzerland ..... 9118/77

[51] Int. Cl.[2] ..... D01H 13/04

[52] U.S. Cl. ..... 57/290; 57/352

[58] Field of Search ..... 57/34 HS, 77.4, 106, 57/290, 332, 352, 284; 242/157 R, 35.5 A

[56] References Cited

U.S. PATENT DOCUMENTS

| | | | |
|---|---|---|---|
| 2,988,867 | 6/1961 | Quittner | 57/77.4 X |
| 3,067,563 | 12/1962 | Van Dijk | 57/34 HS |
| 3,386,143 | 6/1968 | Van Silfhoert | 57/34 HS X |
| 3,445,996 | 5/1969 | Berger, Jr. | 57/34 HS |
| 3,635,008 | 1/1972 | Guy | 57/77.4 |
| 3,680,800 | 8/1972 | Brooks | 242/35.5 R X |
| 4,120,139 | 10/1978 | Terasawa et al. | 57/106 X |

*Primary Examiner*—Donald Watkins

*Attorney, Agent, or Firm*—Kenyon & Kenyon

[57] ABSTRACT

The deflecting element is positioned adajcent to a main heater in order to deflect the thread for two passes in the heater. The deflecting element includes a cylindrical surface which is disposed at an angle to the axis of rotation of the element as well as pair of flanges which define the cylindrical surface. A false twist device is located downstream of the heater to impart a false twist in the thread. The false twist is able to propagate through the thread from the false twist device to the heater and deflecting element back to the supply rolls.

12 Claims, 4 Drawing Figures

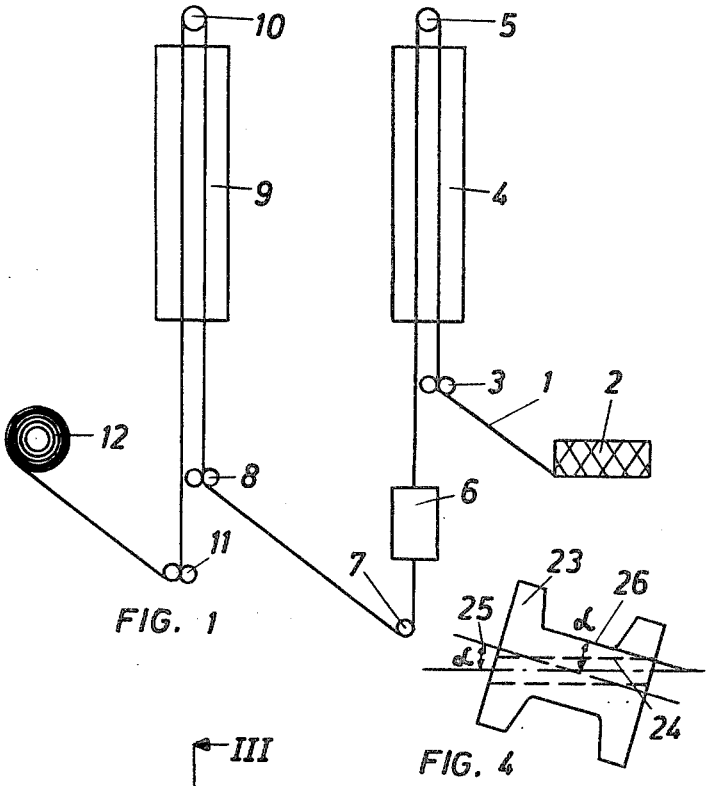
FIG. 1
FIG. 4
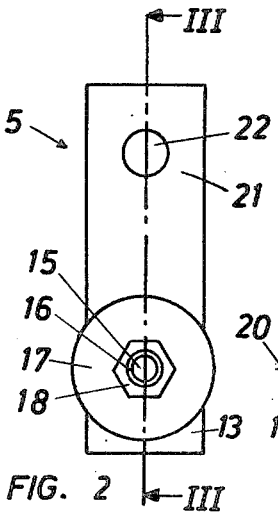
FIG. 2
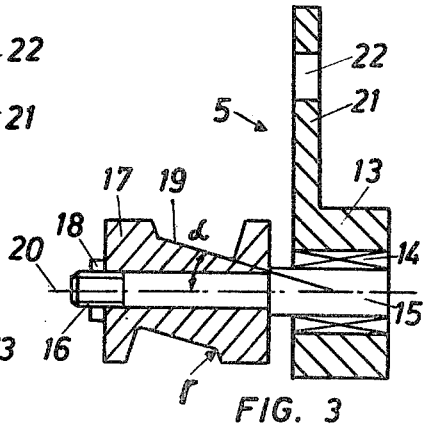
FIG. 3

THREAD DEFLECTING ELEMENT FOR A DRAW-TEXTURING MACHINE

This invention relates to a thread deflecting element. More particularly, this invention relates to a thread deflecting element for a draw-texturing machine.

As is known, draw-texturing machines have frequently been provided with a false twist device in order to impart a false twist texturing to a thread. To this end, the thread is usually drawn between two pairs of rolls and guided over a heater device located between the rolls and through a false twist device also located between the rolls downstream of the heater device. In such a process, the false twist propagates from the false twist device via the heater device up to the first pair of rolls.

If the texturing processing speed is to be increased in these machines, a greater length is required of the heater device in order to maintain the same exposure time on the heater device. Since the length of the heater device cannot be increased indefinitely, some machines have utilized devices for deflecting the thread at the end of the heater in order to guide the thread back over the heater a second time. Such machines are usually used for high speed processes. However, if the thread is deflected by a pin or a rotatable roll, the twist is held back at these deflecting elements in such a manner that practically no twist is propagated into the thread which is guided over the heater device between the deflecting element and the supply rolls and fixed therein. In order to overcome this problem, use of a travelling wire or a vibrating rod which is activated by vibrators has been proposed, for example as described in Swiss Pat. No. 357,499 and U.S. Pat. No. 3,067,563. However, the proposed solutions to the problem can hardly be realized as a practical matter. Further, the false twist effect could not be detected using a rod with vibrators.

Accordingly, it is an object of the invention to provide a simple thread deflecting element for a draw-texturing machine through which a false twist can be propagated without hinderance up to a pair of supply rolls.

It is another object of the invention to provide a thread deflecting element for a draw-texturing machine which permits a false twist to be fixed into a thread which is deflected to pass through a heater in a plurality of passes.

It is another object of the invention to provide a relatively simple thread deflecting element which permits a false twist to be propagated through a thread passing thereover.

Briefly, the invention provides a thread deflecting element for a draw-texturing machine which is comprised of a cylindrical surface disposed about a first axis, a pair of flanges between which the cylindrical surface is disposed and a bore which extends through the element on an axis angularly disposed to the axis of the cylindrical surface at an angle of from five degress (5°) to twenty degress (20°). The flanges of the element are of a larger diameter than the cylindrical surface to confine a travelling thread to the cylindrical surface.

The thread deflecting element is particularly useful in a draw-texturing machine which includes a pair of rolls for supplying a continuous thread therebetween, a main heater for heating a supply thread, a false twist device downstream of the heater relative to the path of the thread for imparting a false twist in the thread and a second pair of rolls downstream of the false twist device for drawing the thread from the supply rollers. In such a machine, a deflecting means is located adjacent to the heater for deflecting the thread to pass the heater in two passes and the deflecting element is incorporated into this means.

The deflecting means includes a cantilevered shaft on which the deflecting element is secured for rotation therewith. In this regard, the deflecting element is in the form of a roll which is supported at the free end of the cantilevered shaft. When in use, a thread is passed over the cylindrical surface of the deflecting element and is able to move to and fro across the cylindrical surface between the flanges while a false twist is propagated through the thread and over the deflecting element.

In one embodiment wherein the textured thread is a polyester, the angle between the cylindrical surface and the axis about which the element rotates is 10°.

It is advantageous if the guide surface of the deflecting element is made smooth and of a wear resistant material such as a material selected from the group consisting of aluminum, steel and ceramics.

These and other objects and advantages of the invention will become more apparent from the following detailed description taken in conjunction with the accompanying drawings wherein:

FIG. 1 illustrates a schematic view of a thread path of a draw-texturing machine utilizing a thread deflecting element in accordance with the invention;

FIG. 2 illustrates a side view of a mounted thread deflecting element in accordance with the invention;

FIG. 3 illustrates a view taken on line III—III of FIG. 2; and

FIG. 4 illustrates a view of a modified deflecting element in accordance with the invention.

Referring to FIG. 1, the draw-texturing machine which is used for drawing various types of threads is supplied with a thread 1 from a supply package 2. As indicated, the machine employs a supply means 3 in the form of a pair of rolls which take off the thread 1 from the supply package 2 in an overhead fashion. In addition, the machine has a main heater 4 for heating the supplied thread, a deflecting means 5 adjacent to the heater for deflecting the thread to pass the heater 4 in two passes, a false twist device 6 downstream of the heater 4 relative to the path of the thread 1 for imparting a false twist in the thread 1, a deflecting device 7 and a second supply means 8 in the form of a pair of rolls. Also, the machine has a set heater 9 downstream of the rolls 8, a deflecting means 10 about which the thread 1 is deflected to make two passes through the set heater 9, and a further pair of rolls 11 from which the thread 1 is directed to be wound onto a take-up bobbin package 12.

As the pair of rolls 8 rotates faster than the first pair of rolls 3, the thread 1 is drawn between the two pairs of rolls 3, 8 in known manner. At the same time, a false twist is imparted to the thread 1 by the false twist device 6. This false twist is propagated through the deflecting means 5 back to the supply rolls 1. Thus, the false twist is fixed in the thread as the thread glides over the heater 4 on the way to the deflecting means 5 as well as on the way from the heater 4 to the rolls 3.

Referring to FIGS. 2 and 3, the deflecting means 5 includes a metal block 13 which acts as a support for a shaft 15 which is journalled via a bearing 14 in the block 13 in cantilevered fashion. The cantilevered end of the shaft 15 is offset and is provided with a threaded portion 16 on the end. In addition, the deflecting means 5 has as deflecting element in the form of a roll 17 secured to the shaft 15 for rotation therewith. To this end, the roll 17 is fixed to rotate with the shaft 15 by means of a nut 18 which is threaded onto the threaded portion 16 of the shaft 15 against the roll 17 while the roll 17 abuts a shoulder of the shaft 15 on the opposite side.

The deflecting roll 17 contains a cylindrical thread guide surface 19 for contact with the thread 1 which is limited by a pair of roll flanges of a larger diameter than the cylindrical surface 19. In addition, a bore extends through the roll 17 to permit mounting of the roll 17 on the shaft 15. The bore and shaft 15 are disposed on a common axis 20.

As shown in FIG. 3, the axis of the cylindrical surface 19 is angularly disposed to the shaft axis 20 at an angle $\beta$ of from 5° to 20°. The thread guide surface 19 thus forms a sleeve surface of an inclined cylinder. Also, the shaft 15 serves as a means to mount the roll 17 for free rotation in response to thread movement about the axis of the surface 19 in angular disposition to the shaft axis 20.

The metal block 13 is provided with a thin extension 21 having an opening 22 for mounting of the thread deflecting means 5 on the machine frame (not shown) above the main heater 4 and outside the zone of maximum heat emission.

During operation, as a thread 1 is being drawn between the pairs of rolls 3, 8 while being heated in the heater 4 and imparted with a false twist by the false twist device 6, the thread 1 causes the freely rotatable roll 17 to rotate with the shaft 15 about the axis 20. As the deflecting roll 17 is in the form of an idler roll, the roll 17 is driven by the thread 1 at approximately the thread transporting speed. As the roll 17 rotates, the inclined cylindrical surface 19 gyrates in such a manner that the thread 1 is also moved to and fro over the guide surface 19 between the two flange ends.

It has been found that the to and fro movement of the thread 1 on the deflecting roll 17 transmits the false twist contained in the thread almost completely. As viewed with respect to the shaft axis 20 (FIG. 3), as the thread 1 is lifted from the smallest to the largest distance away from the shaft axis 20, the thread 1 simply rolls on the guide surface 19 without any influence on the false twist. As the thread moves back from the largest to the smallest deviation from the shaft axis 20, the thread 1 simply glides on the guide surface 19 and the false twist is practically not held back.

As shown in FIG. 3, the transition zone between the guide surface 19 and the roll flanges is preferably provided with a small radius r in such a manner that the change of direction of the thread movement is effected without problem and without damage to the thread.

Experiments have shown that deflecting rolls with a smooth guide surface made from a wear resistant material, for example, from aluminum, steel, ceramics, and the like transmit the twist in the thread particularly well. Furthermore, the angle of inclination $\beta$ of the guide surface 19 with respect to the shaft axis 20 is of importance. Thus, good values of the false twist transmitted through the deflecting elements 17 are obtained if the angle $\beta$, depending upon the type of yarn processed, ranges from 5° to 20°. For example, in processing polyester threads the best results are obtained with the angle $\beta$ at 10° or thereabout.

Referring to FIG. 4, the deflecting roll 23 may alternatively be constructed such that the whole deflecting roll together with the cylindrical surface gyrates. As shown, the deflecting roll 23 has a cross-section which is symmetrical and a bore 24 which is inclined at an angle $\beta$ with respect to the axis of symmetry 25 of the roll 23 and with respect to the cylindrical guide surface 26. A deflecting roll 23 of this type with an inclined bore, however, requires a somewhat more complicated securement on the rotatable shaft (not shown) as compared to the manner of securement of the roll 17 of FIGS. 2 and 3.

The invention thus provides a simple thread deflecting element through which a false twist can be propagated unhampered up to an initial pair of supply rolls while being fixed therein during passes through a heater.

The thread herein referred to may be a synthetic multifilament yarn of any kind.

What is claimed is:

1. In a draw-texturing machine, the combination comprising a first pair of rolls for supplying a continuous thread therebetween;

a main heater for heating a supplied thread;

a false twist device downstream of said heater relative to the path of the thread for imparting a false twist in the thread;

a second pair of rolls downstream of said false twist device relative to the path of the thread for drawing the thread relative to said first pair of rolls; and a deflecting means adjacent said heater for deflecting the thread to pass said heater in two passes, said means including a cantilevered rotatably mounted shaft and a deflecting element secured to said shaft for rotation therewith, said element including a cylindrical surface disposed about a first axis;

a pair of flanges having said cylindrical surface disposed therebetween, said flanges being of larger diameter than said surface; and a bore extending through said element on a second axis angularly disposed to said first axis at an angle of from 5 degrees to 20 degrees.

2. The combination as set forth in claim 1 wherein said shaft is rotatable about said second axis.

3. In combination, a supply means for supplying a continuous thread;

a device downstream of said supply means relative to the path of the thread for imparting a twist in the supplied thread; and a thread deflecting element disposed between said supply means and said device for deflecting the thread thereover, said element including a guide surface for contact with the thread disposed about a first axis, and means mounting said element for rotation about a second axis passing through said element and angularly disposed to said first axis at an angle of from 5 degrees to 20 degrees to permit transmission of a twist in the thread from said device to said supply means.

4. The combination as set forth in claim 3 wherein said element is mounted for free rotation about said second axis in response to thread movement.

5. The combination as set forth in claim 3 wherein said guide surface is cylindrical.

6. The combination as set forth in claim 5 wherein said element includes a pair of flanges having said cylindrical surface disposed therebetween, said flanges being of larger diameter than said surface.

7. The combination as set forth in claim 3 wherein said thread deflecting element is disposed to permit looping of the thread through substantially 180 degrees around said element.

8. The combination as set forth in claim 3 which further comprises a heater for heating the thread upstream of said device and wherein said element is located at one end of said heater to deflect the thread to pass said heater in two passes.

9. The combination as set forth in claim 3 wherein said supply means is a pair of rolls arranged so that twist imparted by said device is transmitted back to the rolls.

10. The combination as set forth in claim 3 wherein said device is a false twist device for imparting a false twist in the supplied thread.

11. The combination as set forth in claim 3 wherein said mounting means comprises a shaft located in a bore in said element and said second axis is the axis of said shaft and said bore.

12. The combination as set forth in claim 11 wherein said element is fixed to said shaft for rotation therewith and which further comprises a support journalling said shaft therein.

* * * * *